United States Patent [19]

Yard

[11] Patent Number: 4,857,012

[45] Date of Patent: Aug. 15, 1989

[54] MULTIPURPOSE BOOT FOR ROUND-TO-FLAT ELECTRICAL CABLE

[76] Inventor: Kenneth G. Yard, 10 Saratoga Dr., Worcester, Mass. 01606

[21] Appl. No.: 123,775

[22] Filed: Nov. 23, 1987

Related U.S. Application Data

[63] Continuation-in-part of Ser. No. 876,671, Jun. 12, 1986, Pat. No. 4,708,664.

[51] Int. Cl.[4] ..... H01R 13/56

[52] U.S. Cl. ..... 439/471; 439/445

[58] Field of Search ..... 439/274–276, 439/395, 399, 404, 407, 445, 447, 452, 464, 587, 588, 892, 607–610

[56] References Cited

U.S. PATENT DOCUMENTS

| | | | |
|---|---|---|---|
| 3,599,172 | 8/1971 | Tuchto | 439/405 |
| 3,874,765 | 4/1975 | Gilmore et al. | 439/464 |
| 4,037,906 | 7/1977 | Jayne | 439/404 X |

*Primary Examiner*—Eugene F. Desmond

*Attorney, Agent, or Firm*—Irving M. Kriegsman

[57] ABSTRACT

A multipurpose boot for use with a jacketed round-to-flat multiconductor electrical cable comprises in one embodiment a sheet of adhesive coated non-conductive flexible plastic material appropriately cut and scored to define a center panel, a pair of fold-over flaps and a tab. In use, the boot is placed about the cable with the tab end disposed at the end of the cable and the end opposite the tab end secured to the cable jacket. When the end of the cable is inserted into a connector for mass termination the tab is inserted along with it. When the connector is subsequently crimped closed the boot effectively connects the connector to the cable jacket so as to physically protect the cable in the area where it is neither flat nor round and to provide strain relief. In another embodiment of the invention the boot is attached at one end to the cable jacket and at the other end to a strip of carrier tape located at the end of the cable for holding the conductors in side by side alignment at that location.

20 Claims, 6 Drawing Sheets

MULTIPURPOSE BOOT FOR ROUND-TO-FLAT ELECTRICAL CABLE

This application is a continuation-in-part of copending U.S. application Serial No. 876,671 filed on June 12, 1986 in the name of Kenneth G. Yard, now Patent No. 4,708,664, issued November 24, 1987.

BACKGROUND OF THE INVENTION

The present invention relates generally to multi-conductor electrical cables and, more particularly, to a multipurpose boot for use with round-to-flat type multi-conductor electrical cables.

Two well known and commonly used types of multi-conductor electrical cables are the round cable and the flat cable.

Round multi-conductor electrical cables, that is, multi-conductor electrical cables in which the conductors are individually insulated from one another and arranged in a group or bundle that is circular in cross-section and in which the conductors are jacketed except for the ends and often shielded, have been used in a variety of applications for several decades. The principal advantage of round cable is that it can be easily bent or angled in most any direction over its entire length, as needed. Other advantages of round cable are that it can be easily and relatively inexpensively shielded and jacketed. The main disadvantage of round cable is that when it is being attached to a connector the conductors have to be connected individually and cannot be mass terminated.

Since the mid 1950's, with the spectacular growth of the computer industry, the flat, or flat ribbon multi-conductor electrical cable, as it sometimes is called, has become increasingly popular, especially as an electrical interconnection for digital equipment. In a flat ribbon type of multi-conductor electrical cable the individual conductors are disposed side by side in a row, electrically separated from each other and fixedly held in such an arrangement by some means, such as tape or plastic. Internal and external interconnection of various functions in computers and other instruments have benefited from the ease of use and compactness of flat ribbon cable. In fact, an entire industry has grown around the manufacture of flat ribbon cable and the necessary connectors, preferably, insulation displacement (IDC) connectors, associated therewith. The main advantage of flat ribbon cable is that when it is being attached to a connector the conductors can be mass terminated (i.e. they do not have to be affixed to the connector individually). The main disadvantage of flat cable is that it cannot be very easily or very conveniently bent or angled to accommodate a particular design requirement. Other disadvantages of flat cable are that the conductors cannot be rearranged to suit particular design needs and that the cable is somewhat more dificult and expensive to shield than round cable.

In response to changing standards imposed by the Federal Communications Commission over the past few years with respect to electromagnetic emissions, shielded versions of these cables and the connectors associated therewith are now available. As a result thereof, these flat cables and connectors have dramatically increased in size and expense.

In order to overcome the problems noted above associated with flat ribbon electrical cable, a third type of cable, namely, a combination of a round type cable and a flat type cable has been developed over the last several years; that is, a cable which is essentially round but made flat at the ends. The conductors are usually enclosed in a jacket over the portion of the cable between the ends where the cable is round, shielded if desired, and held in the proper side by side alignment (i.e. flat) at each end by a strip of an adhesive coated tape, called carrier tape, so that the ends can easily be mass terminated. Such a development has also overcome the crowing and air circulation problems heretofore associated with flat ribbon cable. This recent improvement in flat ribbon cable is commonly referred to in the industry as "round-to-flat" multi-conductor electrical cable, since it is round except for the ends and then flat at the ends. Another advantage of this type of cable over flat ribbon cable is that the conductors can be easily positioned at the ends relative to each other to suit a particular application. Electrical tests for crosstalk and impedance uniformity of round-to-flat multi-conductor cables have proven such cables to be electrically superior to both the shielded and unshielded flat ribbon cable of the past. An example of a round-to-flat multi-conductor cable can be found in an article by Darrell Fernald entitled, "An Alternative to Flat Ribbon Cable," *Electri-Onices*, Dec. 1984.

A number of drawbacks have, however, been associated with the round-to-flat multi-conductor cable. One problem occurs after the cable has been attached to a connector in the portion of the cable where the configuration changes from round to flat; that is, between the ends where the cable is flat and the jacket where the cable configuration is round.

More specifically, in the portion between the connector where the conductors are arranged flat and the jacket where the conductors are round (and hereinafter referred to as the transition area) the conductors are in a loose bundle, are not jacketed, and are not held in any particular alignment. Consequently, any pulling, accidental or intentional, of one or more of the conductors in this transition area may cause these conductors so strained to tear away from the connector to which they are attached. Since the conductors are not attached to each other in the transition area any strain applied to any one particular conductor will not be spread out over the other conductors. Additionally, the conductors in this area are vulnerable to abrasion and other undesirable effects of the surrounding environment. Even further is the concern associated with the positioning of the conductors over this area to provide a desired angular orientation of the cable with respect to the connector to which it is attached or other associated electronic equipment. For example, it has proven difficult to easily and compactly make a ninety degree bend over this area in any direction since loose wires will tend to spread out and end up in a multitude of directions.

Another disadvantage of round-to-flat cable is that because the conductors in the transition area are loose they have a tendency to snag or catch on sharp edges, such as may be present on printed circuit boards, as the cable is being slid into a chassis or housing to its intended position.

In the past, an attempt has been made to solve some of the problems associated with round-to-flat cables over the transition area by placing a piece of shrink tubing, such as a heat shrinkable plastic, over the uncovered conductor portions and then shrinking the tubing (by heat) down to a tight fit. Although this arrangement does provide physical protection of the conductors against electrical shorts where they are not jacketed, it does not provide any strain relief against the individual conductors and in many instances distorts the alignment of wires.

Another technique that has been employed in the past for providing protection and strain relief of the conductors in the transition area has involved using an attachment referred to in the art as a back shell. This attachment, which is made of either metal or a rigid plastic, comprises two mating shell shaped sections which when mounted on the cable fit over the end of the jacketing in the round portion, fit over the conductors in the transition area and fit around and clamp over the connector. Advantages of the back shell are that it does protect the wires in the transition area and does indirectly connect the jacket in the round portion to the connector so as to provide strain relief of the individual wires. The disadvantages of the back shell are that it is cumbersome, bulky, not flexible, expensive to fabricate and is limited in use to only the particular sized and shaped connector for which it is constructed. As can be appreciated there are a variety of different sized and shaped connectors.

Known patents of interest are U.S. Patent 3,744,128 to Fisher et al.; U.S. Patent 4,080,035 to Clark et al.; U.S. Patent 4,497,533 to Genova et al.; and West German Patent Document 2,228,780.

As is apparent, a great need exists to provide an effective means of alleviating the above-mentioned problems associated with round-to-flat multi-conductor electrical cable.

SUMMARY OF THE INVENTION

The present invention overcomes the problems set forth hereinabove by providing a thin, low profile, flexible, multipurpose boot for incorporation with a round-to-flat multi-conductor electrical cable. The boot, which is attached at one end to the cable and at the other end to the connector, has the capability of protecting the conductors against adverse external conditions while simultaneously providing relief from undesirable strain which may be placed on the conductors. Several embodiments of the invention are disclosed and as will hereinafter become readily apparent, the invention can be utilized with all type of insulation displacement (IDC) type connectors.

More specifically, in accordance with the present invention the boot is preferably made of a single sheet of flexible nonconductive plastic material such as PVC, polyester, or polyurethane which is attached at one end to the connector, either directly or indirectly, encompasses the conductors in the transition area and is connected at the other end to either cable conductors or the cable jacket.

In one embodiment, the sheet is configured and arranged so as to encompass the unjacketed and loosely bundled portion of the conductors in the transition area and at the same time be fixedly secured directly to the connector to which the cable is attached as well as to the cable jacket. As a result, the boot acts not only as a means of protecting the conductors, but also because of its shape and arrangement of assembly, as a means of substantially eliminating undesirable strain which may be placed on the conductors in the transition area. The strain relief is accomplished by inserting a tab integrally formed at one end of the boot directly into the connector along with the ends of the conductors of the cable and at the same time securing by any suitable means, such as an adhesive, the other end of the boot to the jacket of the cable. When the top and bottom sections of the connector are crimped shut the boot and the ends of the conductors are secured therein with the boot effectively connecting the connector to the jacket of the cable. Further strain relief is obtained by securing the boot to the conductors in the transition area. By coating the side of the tab in contact with the conductor ends with an adhesive, the boot can also be used as the arrangement for maintaining the ends of the conductors aligned end to end and the carrier tape eliminated, if so desired. In another embodiment the boot is attached to the jacket and to the carrier tape used to maintain the conductors aligned at the end but is not actually inserted into the connector. In still another embodiment, the boot is attached at one end to the carrier tape and at the other end to the conductors just before the jacket rather than to the jacket. In still another embodiment, the carrier tape is eliminated and the boot is attached to the connector and to the cable.

Any suitable means can be used to maintain the boot in place about the conductors and secured to the connector and the cable. Although a number of plastics may be utilized with this invention, it is important to realize that heat shrinkable plastic tubing cannot be used with the present invention since amongst other things it distorts the alignment of wires and is therefore unacceptable in providing for the strain relief afforded by the present invention.

It is therefore an object of this invention to provide a multipurpose boot for a round-to-flat cable that is designed specifically for use in overcoming problems in the transition area where the cable changes from flat to round.

It is another object of this invention to provide a multipurpose boot which protects the conductors of a round-to-flat cable from adverse external conditions in the area noted above.

It is still another object of this invention to provide a multipurpose boot which prevents undesirable strain from adversely affecting the conductors of a round-to-flat cable in the area noted above and also prevents snagging of the cable conductors on sharp edges during installation or maintenance work.

It is a further object of this invention to provide a multipurpose boot which holds the conductors of a round-to-flat cable in an appropriate position prior to and during insertion into a connector for mass termination.

It is still another object of this invention to provide a unique method of making the multipurpose boot of the present invention.

It is still a further object of this invention to provide a multipurpose boot for round-to-flat cable which is economical to produce has a minimum number of parts, is highly effective in operation and not limited to use with only one particularly sized and shaped connector.

For a better understanding of the present invention, together with other and further objects thereof, reference is made to the following detailed description, taken in connection with the accompanying drawings, and its scope will be pointed out in the appended claims.

BRIEF DESCRIPTION OF THE DRAWINGS

In the drawings wherein like reference numerals represent like parts:

FIG. 1(*a*) is a plan view taken from the top of the cable shown in FIG. 1, without the connector;

FIG. 1(*b*) is a plan view taken from the bottom of the cable shown in FIG. 1, without the connector;

FIG. 8(*a*) is a plan view taken from the bottom of the cable system in FIG. 8;

FIG. 10(*a*) is a plan view taken from the bottom of the cable system in FIG. 10;

DETAILED DESCRIPTION OF THE PREFERRED EMBODIMENTS AND METHOD

Figure 1:
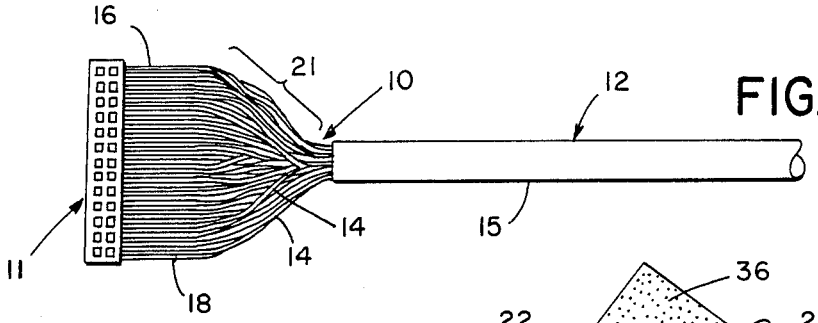
FIG. 1 is a plan view of a conventional round-to-flat cable attached at one end to a conventional connector, the other end of the cable not being shown.

Referring now to the drawings and first to FIGS. 1 through 1(*b*), there is illustrated in FIG. 1 a conventional round-to-flat cable 10 attached at one end to a connector 11. Cable 10 and connector 11 are each of the type more fully described in the Background of the Invention and in the above-referred to article in *Electric-Onics*. For simplicity, only one end of cable 10 is shown. Cable 10 includes a round portion 12 in which a plurality of conductors 14 (which make up the cable) are intertwined and enclosed in a jacket 15 and an end portion 16 in which the ends of conductors 14 are positioned side-by-side in a row. The conductors 14 at end portion 16 are held in side-by-side alignment by a rectangular strip of carrier tape 18 which is disposed underneath end portion 16, is transparent and which is provided with an adhesive coating on the side facing the conductors so that it can be secured thereto. The outer end 16-1 of end portion 16 along with the outer end 18-1 of carrier tape 18 extend into and are clamped between the top and bottom sections of connector 11, which may be commonly available IDC type connector, with the conductor ends in engagement with the tines in the connector. The inner end 18-2 of tape 18 and 16-2 of end 16 are not disposed inside connector 11 but rather extend out therefrom. As clearly illustrated, there is also a transition portion 21 of cable 10 between end portion 16 and jacket 15 where conductors 14 are neither in a flat configuration or a round configuration. They are not enclosed within jacket 15 and are not held in alignment by carrier tape 18 but rather are in a loose bundle. As such, they subject cable 10 to a multitude of problems as noted above including shorting against another element, inadvertant strain with the resultant displacement from the connector, snagging onto sharp edges and difficulty of appropriate angular positioning with respect to connector 11.

The multipurpose boot of the present invention which alleviates the problems described above is made of a sheet of a non-conductive flexible plastic material such as PVC, polyester or polyurethane or other similar material.

Figure 3:
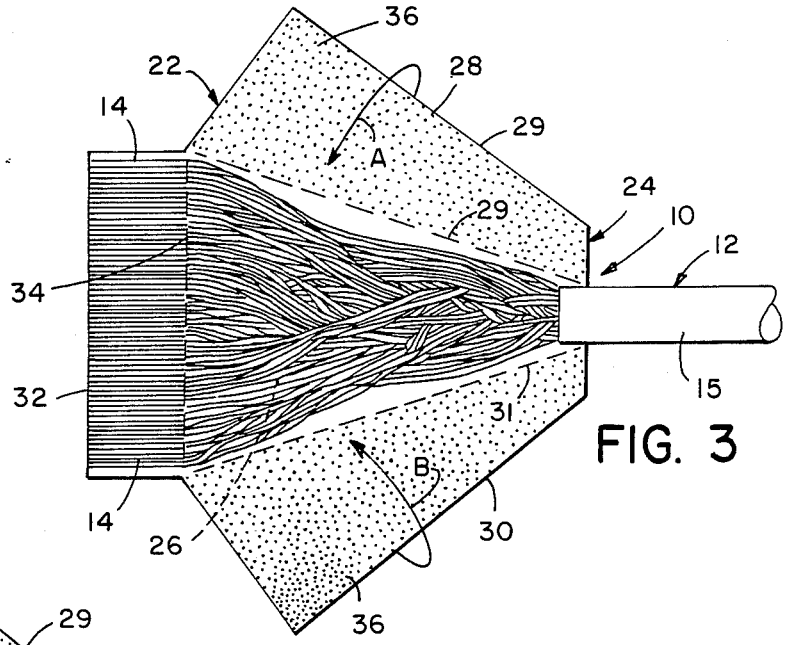
FIG. 3 is a plan view showing the multipurpose boot shown in FIG. 2 in position for attachment to a round-to-flat cable.
Figure 2:
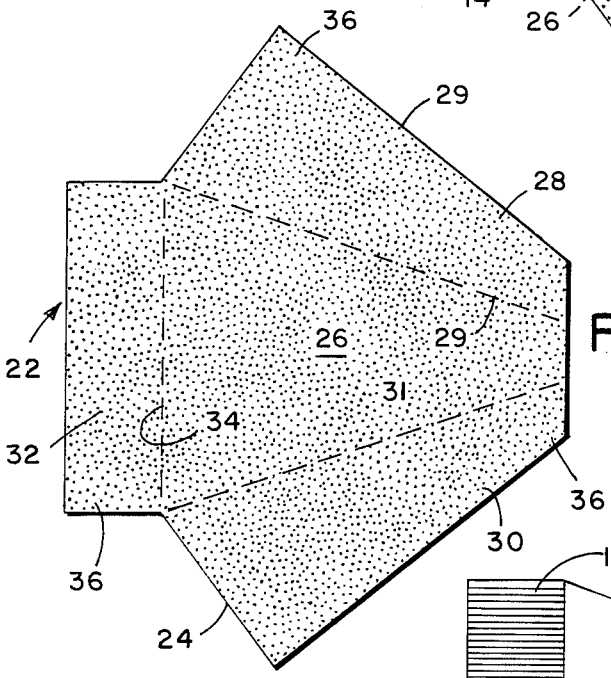
FIG. 2 is a plan view taken from the top of one embodiment of a multipurpose boot of the present invention in an unfolded position prior to assembly onto a cable.
Figure 4:
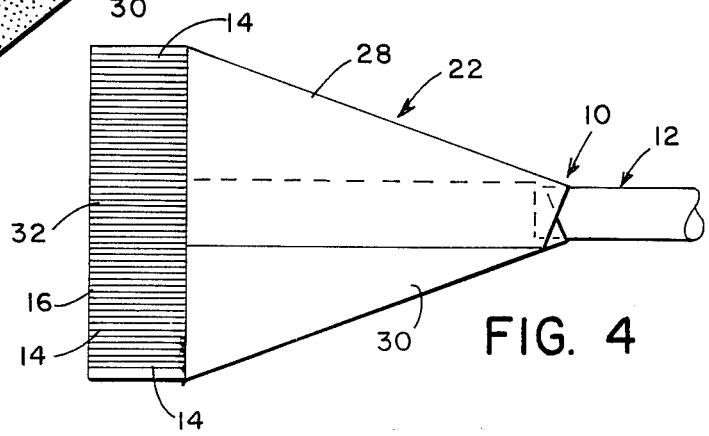
FIG. 4 is a plan view of the multipurpose boot a of FIG. 2 and the round-to-flat cable of FIG. 1, with the boot attached to the cable.
Figure 1A:
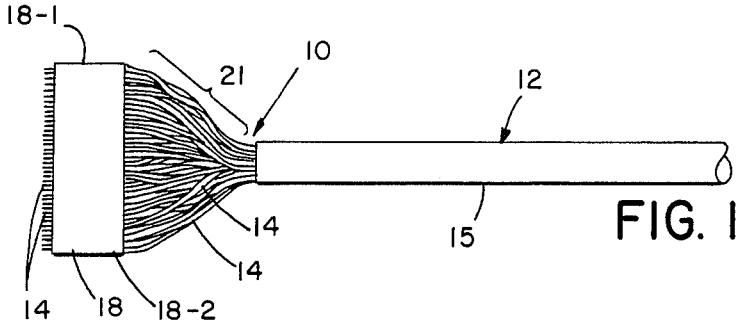
Figure 1B:
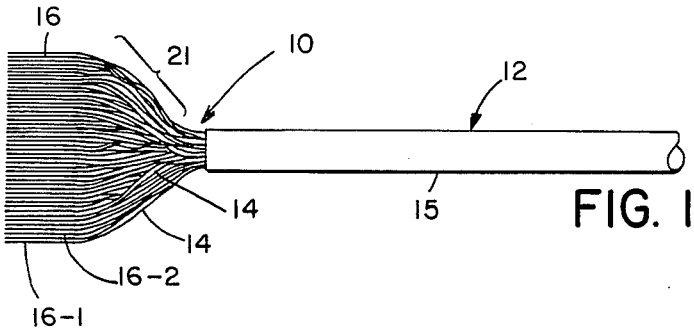

The embodiment of multipurpose boot shown in FIGS. 2–5 is comprised of a single sheet 24 of such material. The actual shape and size of boot 22 may vary according to the angle the cable is to form relative to the connector to which it is attached and the size (length) of the connector. Sheet 24 is cut and scored to define a generally triangular-shaped central panel 26. A pair of opposite, top and bottom, four-sided flaps 28 and 30 extend from top and bottom edges 29 and 31, respectively, of central panel 26, and a generally rectangular tab 32 extends out from side edge 34 of the central panel 26. This unique configuration is clearly shown in FIG. 2 and as can be seen in FIG. 3, when it is to be attached to a cable 10 enables the flaps 28 and 30 to be folded up and over in the direction of arrows A and B to the overlapping position shown in FIG. 4 so as to form a cover over transition portion 21 of cable 10. As can be seen in FIG. 4, conductors 14 at end portion 16 lie upon tab 32 for subsequent insertion into connector 11 in the manner described in detail hereinbelow. Additionally, as shown in FIG. 2, flaps 28 and 30, tab 32 and panel 26 have a coating of an adhesive 36 such as a heat sealable or pressure sensitive adhesive thereon. It should also be noted, and as can be seen in FIGS. 3 and 4, boot 22 also extends over the end of jacket 15 and is fixedly secured to jacket 15 by a suitable means such as an adhesive 36.

It is of utmost importance in the invention that although a number of different flexible plastic materials such as PVC, polyester or polyurethane may be utilized for the boot the ues of a heat shrinkable plastic material is unacceptable. As noted above, tab 32 which extends out from side edge 34 of triangular-shaped central portion 26 of boot 22 also has incorporated therewith a coating of an adhesive 36. As can be appreciated, since adhesive 36 will hold the conductors 14 in place on tab 32 in side by side flat arrangement, carrier tape such as used in the cable in FIG. 1 may, if desired, be eliminated.

As clearly depicted in FIG. 3, when boot 22 is being attached to cable 10 the conductors 14 are placed on the substantially triangular-shaped portion 26 of boot 22 with the ends of the conductors 14 resting on tab 32. Thereafter flap 30 is folded over conductors 14. Flap 28 is then folded over flap 30. Thereafter, heat is applied to activate the adhesive 36 if it is heat sealable or pressure if it is pressure sensitive and bond the boot 22 in place over conductors 14 and to the end of jacket 15 on cable 10. It is important to note that the plastic is not heat shrinkable and that the heat merely activates the adhesive, although other types of non-heat sealable adhesives may be utilized with the present invention. Cable 10, with boot 22 attached thereto is shown in FIG. 4.

Figure 5:
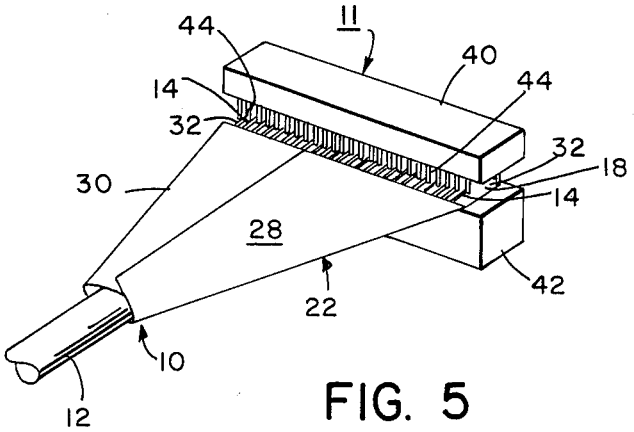
FIG. 5 is a pictorial representation of the cable and boot shown in FIG. 4 mounted on a connector with the top and bottom sections of the connector not fully clamped closed.

After boot 22 encompasses conductors 14 and the end of jacket 15 and is secured in place, cable 10 is attached to connector 11 by inserting the outer end of end portion 16 of cable 10 and the corresponding portion of carrier tape 18 and tab 32 of boot 22 between the top and bottom parts 40 and 42, respectively of electrical connector 11 (see FIG. 5). The connector sections 40 and 42 are then clamped together, as is customary with this type of connector, securing end portion 16 of cable 10 and tab 32 therebetween. As is clearly evident by the illustration of FIG. 5, the tines 44 of connector 11 not only provide the appropriate electrical contact with conductors 14 but also fixedly secure tab 32 of boot 22 to connector 11. Since tines 44 also cut through and contact boot 22, the material used for boot 22 is by necessity non-conductive.

Instead of first attaching boot 22 to cable 10 and then to connector 11, boot 22 and conductors 14 may first be attached to connector 11 and then boot 22 attached to cable 10.

With the boot attached as depicted in FIG. 5 of the drawings, strain relief is provided for conductors 14. In addition, conductors 14 are no longer exposed to adverse environmental effects and wear of conductors 14 is substantially reduced.

Instead of fabricating boot 22 from a single sheet of material, boot 22 may be made of two sheets of material similar in shape to the FIG. 2 embodiment but without the flaps 28 and 30, with one sheet positioned below the cable and the other above the cable and with both sheets secured to the cable and to each other by any suitable means such as an adhesive.

Figure 6:
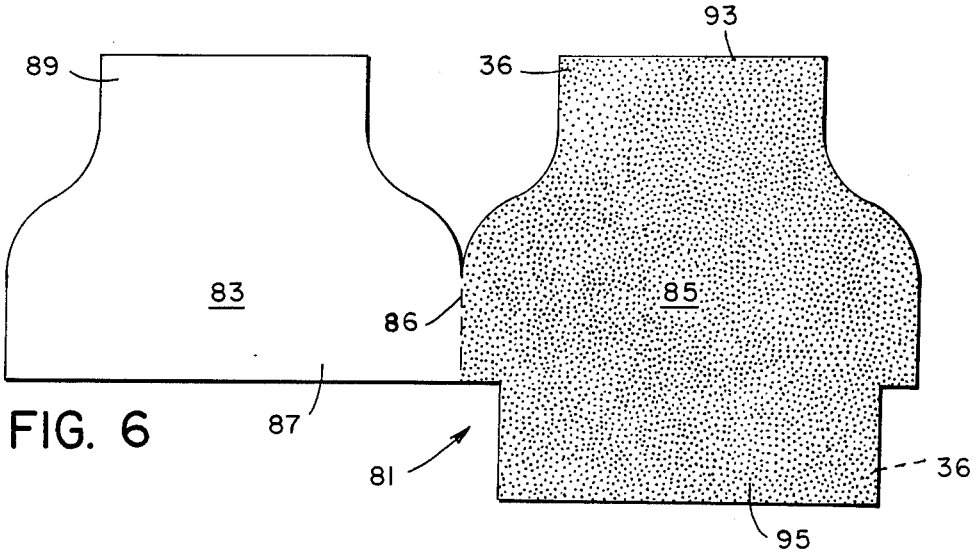
FIG. 6 is a plan view of another embodiment of the invention.

In FIG. 6 there is shown another embodiment of the invention identified by reference numeral 81. Boot 81 is made of a sheet of flexible non-conductive plastic material cut and scored to define a left section 83 and a right section 85, the two sections being separated by a fold line 86. Left section 83 includes a main panel 87 having a top portion 89. Right section 85 includes a main panel 91 having a top portion 93 and a bottom tab portion 95. Adhesive 36 is provided on right section 85. In use cable 10 is placed on right section 85 such that end portion 16 is on tab 95 with top portions 89 and 93 overlapping and being secured to the jacket of the cable 15. Left section 83 is then folded over on top of cable 10 and secured to right section 85. Tab portion 95 and the cable ends are then inserted into connector 11.

Figure 7:
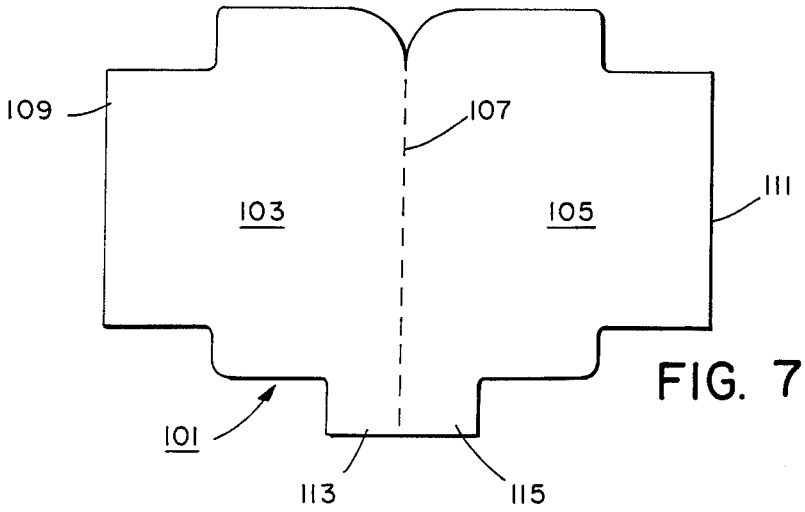
FIG. 7 is a plan view of still another embodiment of the invention.

Another embodiment of the invention for use with a cable in which the conductor ends are at a 90 degree angle to the longitudinal axis of the cable is shown in FIG. 7 and identified by reference numeral 101. Boot 101 comprises a sheet of flexible plastic material cut and scored to define a left section 103 and a right section 105, the two sections being separated by a fold line 107. Each section 103, 105 contains a connector engaging tab 109 and 111, respectively, and a jacket encompassing projection 113 and 115, respectively. Alternatively, one of tabs 109 and 111, such as tab 111, may be omitted. A coating of adhesive 36 is deposited on one section, such as section 103. In use, the two sections 103, 105 are folded over onto the cable with tabs 109 and 111 engaging the flat end of the cable and panels 113 and 115 engaging the cable jacket.

If desired, a sheet of conductive foil for use as shielding may be disposed between boot 22, 81, 101 or any variations thereof and the cable to which it is attached, the size and shape of the foil conforming to the size and shape of the boot.

Figure 8A:
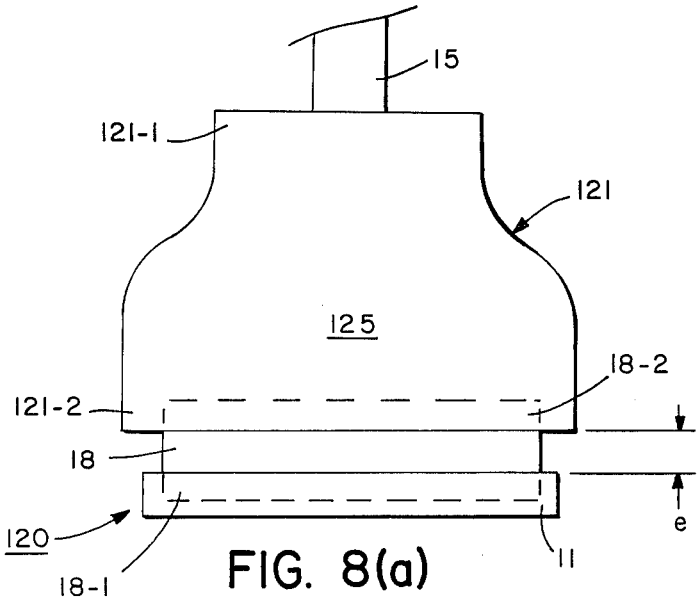
FIG. 8 is a plan view taken from the top of another cable system according to the invention.
Figure 8:
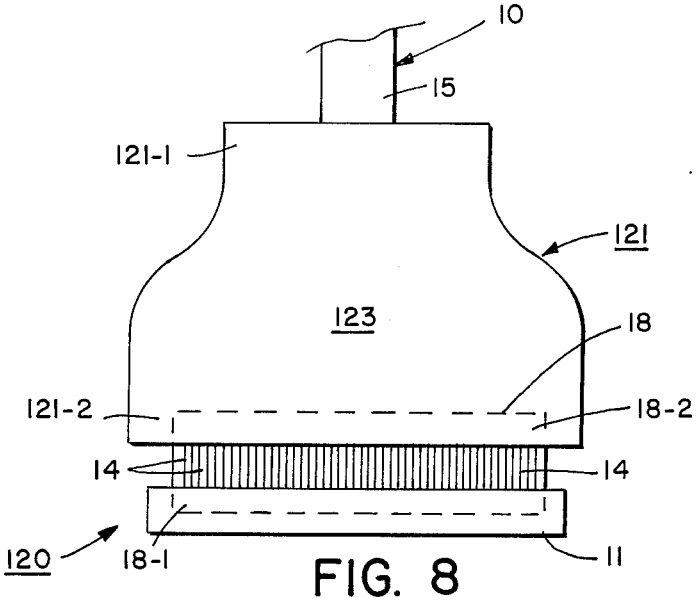
Figure 9:
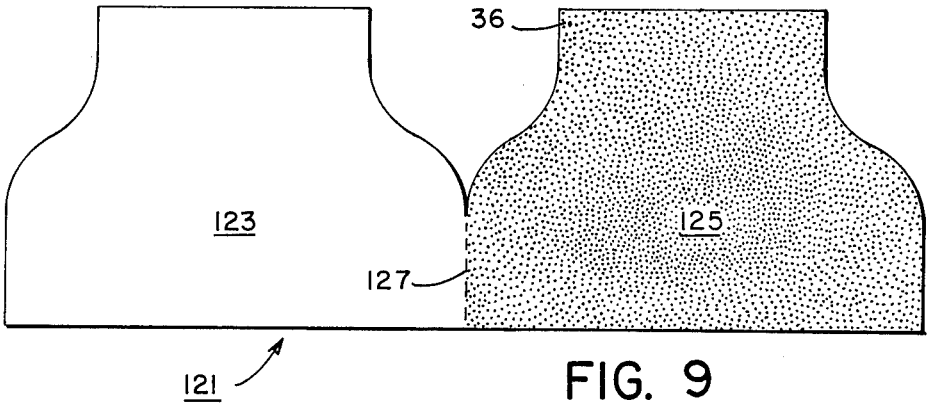
FIG. 9 is a plan view of the boot shown in FIG. 8 and unfolded.

In FIGS. 8 and 8(*a*) there is shown another cable system 120 according to this invention. System 120 includes jacketed cable 10, a connector 11 and a boot 121. The conductors 14 at the end of cable 10 are held aligned by a strip of carrier tape 18. The front end 18-1 of carrier tape and the ends of the conductor 14 extend into and are clamped inside connector 11. Boot 121 is attached at its front end 121-2 to the rear end 18-2 of carrier tape 18 and spaced a small distance e from connector 11 and at the back end 121-2 is attached to cable jacket 15. Boot 121, which is shown unfolded in FIG. 9, comprises a sheet of nonconductive flexible plastic material having a left section 123 and a right section 125 separated from each other by fold line 127. Right section 125 includes an adhesive coating 36 on one side. Boot 121 is similar to boot 81, the difference being that in boot 121, the bottom tab is omitted since the boot is not inserted into the connector. Since boot 121 is spaced from connector 11, the conductors 14, which are usually color coded are visible when viewed from the side not containing the tape 18 and if tape 18 is made of a transparent material, from that side also.

Figure 10:
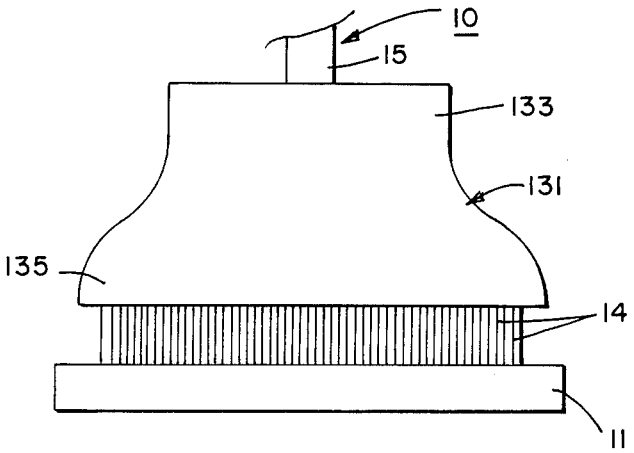
FIG. 10 is a plan view taken from the top of another cable system of the invention.
Figure 10A:
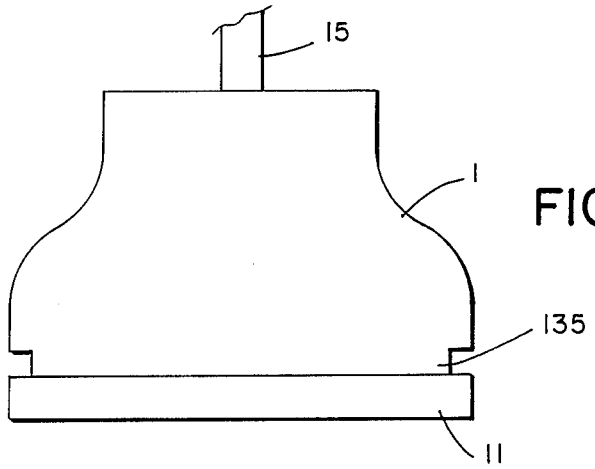
Figure 11:
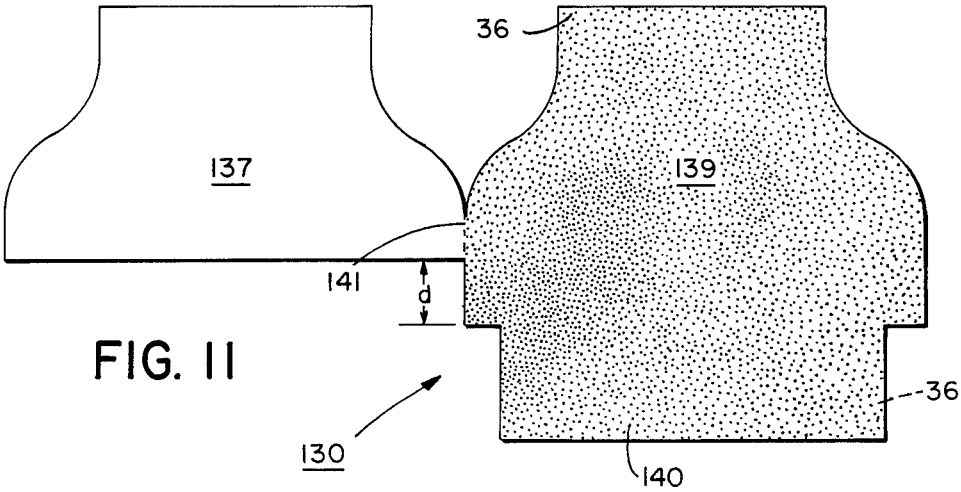
FIG. 11 is a plan view of the boot in FIG. 10 and unfolded.

In FIGS. 10 and 10(*a*) there is shown another cable system 130 according to this invention. System 130 includes a jacketed cable 10, a connector 11 and a boot 131. Boot 131 is attached at its rear end 133 to jacket 15 and at its front end 135 to connector 11. Boot 131, which is shown unfolded in FIG. 11, comprises a sheet of nonconductive flexible plastic material having a left section 137 and a right section 139, right section 139 having a tab portion 140 which is inserted into connector 11 and separated from left section 137 by a fold line 141. Section 139 includes an adhesive coating 36. Boot 131 is similar to boot 81, the difference being that left section 137 is made shorter than right section 139 by a distance d so that the conductors can be seen as shown in FIG. 10 when viewed from the side containing left section 137. If desired, the carrier tape (not shown) can be eliminated and the conductor ends held aligned prior to insertion in connector 11 by tab 141.

Figure 12:
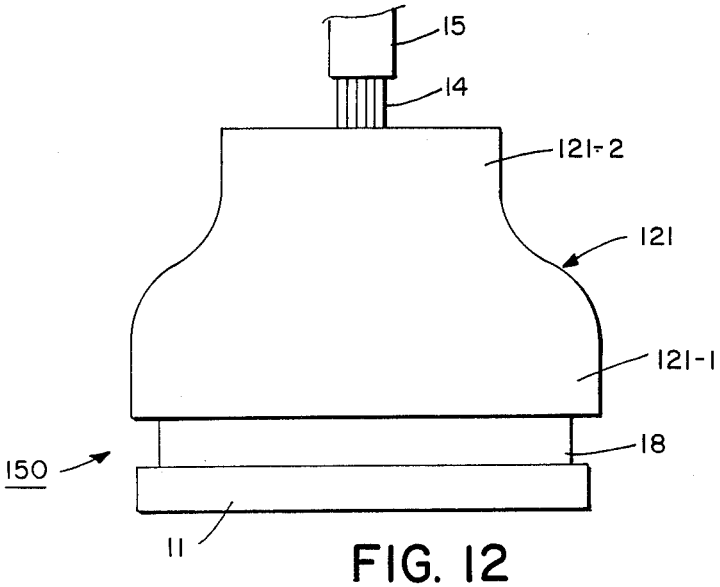
FIG. 12 is a plan view taken from the top of another cable system of the invention.

In FIG. 12 there is shown a cable system 150 according to this invention wherein boot 121 is attached at its outer end 121-1 to carrier tape 18 as in FIG. 8 and at its inner end 121-2 to conductors 14, rather than jacket 15.

Figure 13:
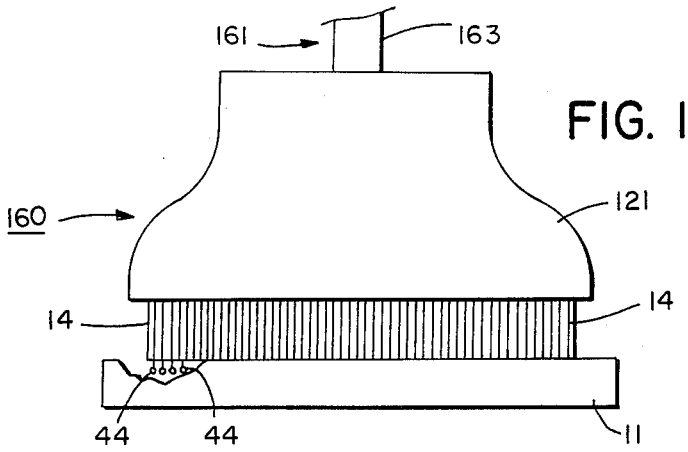
FIG. 13 is a plan view partly broken away, taken from the top of another cable system of the invention.

In FIG. 13 there is shown a cable system 160 which includes a jacketed rough-to-flat cable 161, wherein the carrier tape is omitted, conductors 14 are individually connected to the tines 44 in the connector and boot 121 is connected at its back end to cable jacket 15 and at its front other end to the conductors 14.

Figure 14:
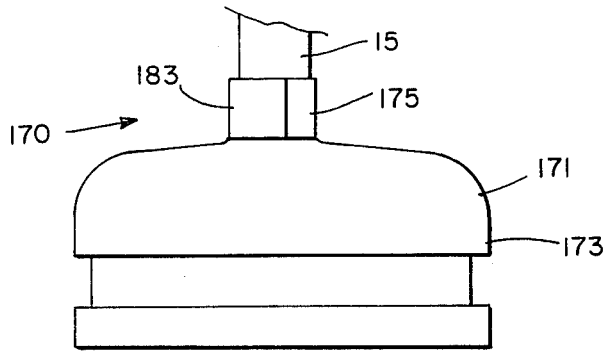
FIG. 14 is a plan view of still another cable system of the invention.
Figure 15:
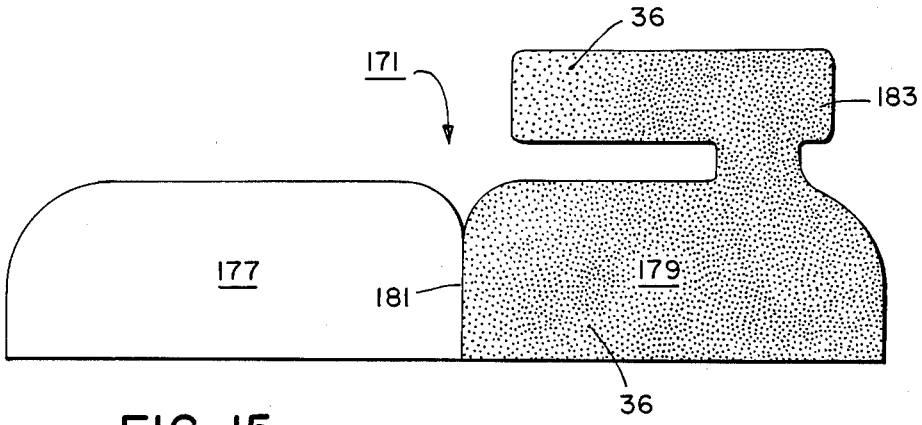
FIG. 15 is a plan view of the boot shown in FIG. 14 and unfolded.

In FIG. 14 there is shown a cable system 170 in which boot 171 is attached at its outer end 173 to carrier tape and is wrapped around the cable jacket 15 at its inner end 175. Boot 171 which is shown unfolded in FIG. 15 includes left and right sections 177 and 179, respectively, connected by a fold line 181, right section 179 including a uniquely shaped tab 183 which is intended to wrap around the cable jacket (or, if desired, the bundle of round conductors).

It is to be understood that although the present invention has been described with reference to particular embodiments and method of assembling those embodiments, it is also to be understood that various modifications and changes may be made as fall within the spirit and scope of the invention as set forth in the appended claims.

What is claimed is:

1. A cable system comprising an insulation displacement connector which is mass terminatable, a round-to-flat multiconductor cable and a boot, said round-to-flat multiconductor cable having an end portion where the conductors are in a flat configuration, a round portion where the conductors are in a round configuration and enclosed over at least a portion thereof in a jacket and a transitory portion where the conductors are not in a flat configuration and not in a round configuration and not jacketed, at least a portion of said end portion extending into and being secured to said insulation displacement connector, said boot comprising a sheet of flexible non-conductive material, said boot being attached to said end portion and to said round portion and encompassing said conductors in said transitory portion.

2. The cable system of claim 1 and wherein the boot is shaped so that a portion of the conductors at the end portion are visible.

3. The cable system of claim 2 and wherein the sheet of material comprises a left section and a right section, the right section being separated from the left section by a fold line and having a tab portion which is inserted into the connector.

4. The cable system of claim 3 and wherein the left section is sized so that the conductors are visible when the tab portion is inserted into the connector.

5. The cable system of claim 4 and wherein the sheet of material is a plastic.

6. The cable system of claim 5 and further including adhesive means on said sheet for securing the boot to the conductors and to the jacket.

7. The cable system of claim 1 and wherein the insulation displacement connector includes a plurality of tines, the conductors are individually attached to the tines and the boot is connected at one end to the conductors and at the other end to the cable jacket.

8. The cable system of claim 7 and wherein the sheet of material is a plastic.

9. The cable system of claim 8 and wherein the plastic is selected from a group consisting of PVC, polyester and polyurethane.

10. The cable system of claim 1 and wherein the sheet of flexible non-conductive material is a plastic.

11. The cable system of claim 10 and wherein the plastic is selected from a group consisting of PVC, polyester and polyurethane.

12. The cable system of claim 10 and wherein the sheet of material is cut and scored to define a pair of sections separated by a score line.

13. The cable system of claim 12 and further including adhesive material on said boot for securing the boot to the insulation displacement connector and to the cable.

14. The cable system of claim 13 and wherein the pair sections are equal in size and shape.

15. A cable system comprising:

a. a round-to-flat multiconductor cable, said round-to-flat multiconductor cable having an end portion where the conductors are in a flat configuration, a round portion where the conductors are in a round configuration and enclosed over at least a portion in a jacket and a transitory portion between the end portion and the round portion where the conductors are not in a flat configuration and not in a round configuration, b. a strip of carrier tape attached to said round-to-flat multiconductor cable at said end portion and serving to maintain said conductors aligned flat at said end portion, c. an insulation displacement connector which is mass terminatable attached to said end portion, and d. a boot comprising a sheet of flexible non-conductive material, said boot being connected to said round portion where jacketed and to said carrier tape and encompassing said conductors in said transitory portion and not extending into said insulation displacement connector.

16. A cable system comprising:

a. a round-to-flat multiconductor cable, said round-to-flat multiconductor cable having an end portion where the conductors are in a flat configuration, a round portion where the conductors are in a round configuration and enclosed over at least a portion in a jacket and a transitory portion between the end portion and the round portion where the conductors are not in a flat configuration, not in a round configuration and not jacketed, b. a strip of carrier tape attached to said round-to-flat multiconductor cable at said end portion and serving to maintain said conductors aligned flat at said end portion, c. an insulation displacement connector which is mass terminatable attached to said end portion, and d. a boot comprising a sheet of flexible non-conductive material, said boot being connected to said carrier tape and said round portion where not jacketed and encompassing said wires in said transitory portion.

17. A cable system comprising:

a. a round-to-flat multiconductor cable, said round-to-flat multiconductor cable having an end portion where the conductors are in a flat configuration, a round portion where the conductors are in a round configuration and enclosed over a portion thereof in a jacket and a transitory portion between the end portion and the round portion where the conductors are not in a flat configuration, and not in a round configuration, b. a strip of carrier tape at said end portion for maintaining said conductors aligned at said end portion, c. a boot connected to a portion of said round portion that is not jacketed and to said carrier tape, and encompassing said conductors in said transitory portion, said boot comprising a sheet of flexible non-conductive material, and d. an insulation displacement connector attached to said end portion and to said carrier tape.

18. A cable system comprising:

a. a round-to-flat multiconductor cable, said round-to-flat multiconductor cable having an end portion where the conductors are in a flat configuration, a round portion where the conductors are in a round configuration and enclosed over at least a portion thereof in a jacket and a transitory portion between the end portion and the round portion where the conductors are not in a flat configuration and not in a round configuration, b. a strip of carrier tape at said end portion for maintaining said conductors aligned at said end portion, c. a boot attached to said jacketed portion of round portion and to said end portion and said carrier tape and encompassing said conductors in said transitory portion, said boot comprising a sheet of flexible non-conductive material; and d. an insulation displacement connector attached to said end portion and said carrier tape and said boot.

19. A cable system comprising:

a. a round-to-flat multiconductor cable, said round-to-flat multiconductor cable having an end portion where the conductors are in a flat configuration, a round portion where the conductors are in a round configuration and enclosed over at least a portion in a jacket and a transitory portion between the end portion and the round portion where the conductors are not in a flat configuration and not in a round configuration, b. a strip of carrier tape at said end portion for maintaining said conductors aligned at said end portion, c. a boot attached to said end portion and to said carrier tape and having a tab wrapped around said jacketed portion of said round portion and secured thereto, and d. an insulation displacement connector attached to said end portion and said carrier tape and said boot.

20. A cable system comprising:

a. a round-to-flat multiconductor cable, said round-to-flat multiconductor cable having an end portion where the conductors are in a flat configuration, a round portion where the conductors are in a round configuration and enclosed in a jacket and a transitory portion between the end portion and the round portion where the conductors are not in a flat configuration and not in a round configuration, b. a strip of carrier tape at said end portion for maintaining said conductors aligned at said end portion, c. a boot attached to said round portion and to said end portion and to said carrier tape and having a tab wrapped around said unjacketed portion of said round portion and secured thereto, and d. an insulation displacement connector attached to said end portion and said carrier tape and said boot.

* * * * *